US009914281B2

(12) United States Patent
Grünwald et al.

(10) Patent No.: US 9,914,281 B2
(45) Date of Patent: Mar. 13, 2018

(54) ASSEMBLY FOR PRODUCING AN ENDLESS CORRUGATED CARDBOARD WEB LAMINATED ON AT LEAST ONE SIDE

(71) Applicant: BHS Corrugated Maschinen-und Anlagenbau GmbH, Weiherhammer (DE)

(72) Inventors: Gerhard Grünwald, Freudenberg (DE); Florian Müller, Weiherhammer (DE); Wolfgang Janner, Mantel (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 14/662,557

(22) Filed: Mar. 19, 2015

(65) Prior Publication Data

US 2015/0266257 A1 Sep. 24, 2015

(30) Foreign Application Priority Data

Mar. 20, 2014 (DE) ..... 10 2014 205 251

(51) Int. Cl.
*B31F 1/22* (2006.01)
*B05D 5/00* (2006.01)
(Continued)

(52) U.S. Cl.
CPC ..... *B31F 1/225* (2013.01); *B05C 1/0826* (2013.01); *B05D 5/00* (2013.01); *B31F 1/2818* (2013.01); *B31F 1/2877* (2013.01)

(58) Field of Classification Search
CPC ..... B05C 1/0826; B05C 21/00; B05D 5/00; B31F 1/225; B31F 1/2818; D06B 1/00
(Continued)

(56) References Cited

U.S. PATENT DOCUMENTS 2,797,661 A 7/1957 Leaming
3,498,246 A * 3/1970 Kiefer ..... E04H 4/143 114/267
(Continued)

FOREIGN PATENT DOCUMENTS

CN 201793116 U 4/2011
DE 39 24 273 A1 1/1991
(Continued)

*Primary Examiner* — Philip C Tucker
*Assistant Examiner* — Jimmy R Smith, Jr.
(74) *Attorney, Agent, or Firm* — McGlew and Tuttle, P.C.

(57) ABSTRACT

The invention relates to an assembly for producing an endless corrugated cardboard web laminated on at least one side, the assembly comprising a first corrugating roller and a second corrugating roller for producing a corrugated web provided with a corrugation as well as a glue application assembly. The glue application assembly comprises a glue container for receiving glue, a glue application roller for applying the glue disposed in the glue container to tips of the corrugation of the corrugated web, and at least one glue wave inhibiting assembly arranged in the glue container for inhibiting the formation of glue waves of the glue disposed in the glue container. The assembly for producing an endless corrugated cardboard web laminated on at least one side further has a pressure assembly for pressing a cover layer against the tips, provided with glue, of the corrugated web.

17 Claims, 5 Drawing Sheets

(51) Int. Cl.
*B05C 1/08* (2006.01)
*B31F 1/28* (2006.01)

(58) Field of Classification Search
USPC ..... 156/470; 427/434.5; 137/571, 574; 118/429
See application file for complete search history.

(56) References Cited

U.S. PATENT DOCUMENTS

| | | | | |
|---|---|---|---|---|
| 3,930,465 | A * | 1/1976 | Schuierer | D06B 1/06 118/325 |
| 2008/0248206 | A1* | 10/2008 | Della Torre | B31F 1/07 427/331 |
| 2009/0117376 | A1* | 5/2009 | Bloembergen | B05C 1/0813 428/341 |
| 2010/0192850 | A1 | 8/2010 | Kim et al. | |

FOREIGN PATENT DOCUMENTS

| | | | |
|---|---|---|---|
| EP | 0 536 518 | A1 | 4/1993 |
| EP | 0 839 584 | A2 | 5/1998 |
| GB | 2 131 742 | A | 6/1984 |
| JP | 2003-245 988 | A | 9/2003 |
| WO | 2006/086754 | A2 | 8/2006 |

* cited by examiner

ASSEMBLY FOR PRODUCING AN ENDLESS CORRUGATED CARDBOARD WEB LAMINATED ON AT LEAST ONE SIDE

CROSS-REFERENCE TO RELATED APPLICATIONS

This application claims the priority of German Patent Application, Serial No. 10 2014 205 251.3, filed on 20 Mar. 2014, pursuant to 35 U.S.C. 119(a)-(d), the content of which is incorporated herein by reference in its entirety as if fully set forth herein.

FIELD OF THE INVENTION

The invention relates to an assembly for producing an endless corrugated cardboard web laminated on at least one side. The invention further relates to a glue application assembly as a component of an assembly for producing an endless corrugated cardboard web laminated on at least one side.

BACKGROUND OF THE INVENTION

Assemblies of the generic type for producing endless corrugated cardboard webs laminated on at least one side and glue application assemblies thereof are generally known from prior art through prior public use. A common disadvantage thereof is that the glue is unevenly applied to a corrugated web to which glue is to be applied, which may impair the glue joint between the corrugated web and a cover web to be joined thereto therewith.

SUMMARY OF THE INVENTION

An object of the invention is therefore to provide an assembly for producing an endless corrugated cardboard web laminated on at least one side which allows a particularly high-quality and in particular even glue joint to be formed between a corrugated web and a cover web to be joined thereto. A corresponding glue application assembly shall be provided as well.

According to the invention, this object is achieved by an assembly for producing an endless corrugated cardboard web laminated on at least one side, comprising a first corrugating roller and a second corrugating roller to produce a corrugated web provided with a corrugation, a glue application assembly comprising a glue container for receiving glue, a glue application roller for applying the glue disposed in the glue container to tips of the corrugation of the corrugated web, and at least one glue wave inhibiting assembly arranged in the glue container for inhibiting the formation of glue waves of the glue disposed in the glue container, and a pressure assembly for pressing a cover layer against the tips of the corrugated web provided with glue. This object is further achieved by a glue application assembly as a component of an assembly for producing an endless corrugated cardboard web laminated on at least one side according to the invention, comprising a glue container for receiving glue, a glue application roller for applying the glue disposed in the glue container to tips of the corrugation of the corrugated web, and at least one glue wave inhibiting assembly arranged in the glue container for inhibiting the formation of glue waves of the glue disposed in the glue container. The gist of the invention is that in the glue container, at least one glue wave inhibiting assembly is arranged which is able to inhibit the formation of glue waves in the glue container. In particular, the at least one glue wave inhibiting assembly is adapted to reduce the size and/or the number, for example, of glue waves in the glue container, or to prevent them from forming altogether. The at least one glue wave inhibiting assembly preferably acts as a wave breaker for the glue received in the glue container. In known glue application assemblies, the glue waves are in particular produced by the rotation of the glue application roller, a glue metering roller (if any), a displacement of the glue application assembly (if possible), and/or by the flow of glue into the glue container.

Preferably, the at least one glue wave inhibiting assembly reduces the flow or the flow speed of the glue in the glue container. It is advantageous if the at least one glue wave inhibiting assembly calms the glue in the glue container.

As a result, a particularly even application of glue to the corrugated web to be coated with glue is obtained while preventing the glue disposed in the glue container from passing or spilling over the top of the glue container or of glue dams (if any).

It is advantageous if the at least one glue wave inhibiting assembly protrudes from the glue in the glue container. Advantageously, at least part, in particular the greatest part, of the at least one glue wave inhibiting assembly is immersed in the glue disposed in the glue container.

The glue container is preferably configured as a glue tray.

It is advantageous if exactly one glue wave inhibiting assembly is provided. Alternatively, several glue wave inhibiting assemblies are provided. Advantageously, the glue wave inhibiting assemblies are then arranged one behind the other such as to have various distances from the glue application roller.

It is advantageous if the distance of the glue application roller from the first and/or second corrugating roller is adjustable. The glue application roller is preferably driven for rotation.

It is advantageous if the first corrugating roller and the second corrugating roller are drivable or drivable for rotation. Between the corrugating rollers, a material web is passed through which is provided with corrugations or flutes by means of the corrugating rollers.

In order to press a cover web against the corrugated web, the pressure assembly preferably comprises at least one pressure roller or a pressure belt circulating around at least two deflection rollers. The cover web may form an outer or inner web of the corrugated cardboard web.

Advantageously, the assembly for producing an endless corrugated cardboard web laminated on at least one side is part of a corrugated cardboard installation. The corrugated cardboard installation may comprise several assemblies of this type.

The assembly provided with a glue metering roller which forms, together with the glue application roller, a preferably adjustable gap for forming a preferably even glue layer on the glue application roller, wherein the glue metering roller is arranged between the glue application roller and the at least one glue wave inhibiting assembly, allows a particularly even glue layer to be formed on the glue application roller. The glue metering roller is arranged adjacent to the glue application roller.

The at least one glue wave inhibiting member of the at least one glue wave inhibiting assembly comprising at least one glue wave inhibiting member which is preferably configured in the manner of plates or strips or as a shaped part preferably forms a wall, in other words a dam. Preferably, the at least one glue wave inhibiting member is plane and in the shape of plates or strips. Alternatively, it is configured as a shaped part such as to have regions with different orientations. It is advantageous if the at least one glue wave inhibiting member is replaceable. Advantageously, the distance of the at least one glue wave inhibiting member from the glue application roller is adjustable as well. Advantageously, the at least one glue wave inhibiting member is height-adjustable.

It is advantageous if the at least one glue wave inhibiting member is configured such that a displacement of at least one glue dam is still possible, thus allowing said glue dam to be arranged in close vicinity to the glue application roller and/or the glue metering roller. To this end, the at least one glue wave inhibiting member Advantageously has at least one recess that is upwardly open, said recess extending at least across the displacement path of the respective glue dam. The glue dam, strictly speaking a holder thereof, engages the respective recess at least partly. Alternatively, the at least one glue wave inhibiting member is configured without such recess(es).

Preferably, at least part, more preferably at least the greatest part, of the at least one glue wave inhibiting member is arranged in the glue disposed in the glue container. It is advantageous if the at least one glue wave inhibiting member extends in the glue disposed in the glue container at least in the region of the glue surface or at least in an upper region of the glue disposed in the glue container.

In an advantageous embodiment of the invention, the at least one glue wave inhibiting member extends at least partly between side walls of the glue container. The at least one glue wave inhibiting member preferably extends at least partly across the width, more preferably across the entire width, of the glue container. In other words, in the region of the glue application assembly, it advantageously extends in a direction transverse to the transport direction of the corrugated web. The at least one glue wave inhibiting member may be in a fluid-tight connection with the side walls. Alternatively, the glue wave inhibiting member ends at a distance from at least one side wall or from the side walls of the glue container.

The arrangement of the at least one glue wave inhibiting member such as to extend vertically or at an angle relative to a vertical allows the formation of glue waves in the glue container to be inhibited particularly effectively. The at least one glue wave inhibiting member extends vertically. Alternatively, it is at an angle relative to a horizontal. The at least one glue wave inhibiting member is then preferably arranged at an angle of up to 60° relative to the vertical.

The embodiment in which an inclination of the at least one glue wave inhibiting member is displaceable relative to a vertical allows at least the at least one glue wave inhibiting member to be particularly easily adapted to machine influences or influences from the surroundings. The at least one glue wave inhibiting member is preferably displaceable manually or by means of at least one displacement drive. Preferably, it is possible as well to change the inclination during the operation of the assembly for producing an endless corrugated cardboard web laminated on at least one side.

In an advantageous embodiment of the invention, at least part, preferably at least the greatest part, of the at least one glue wave inhibiting member is bendable or flexible. The at least one glue wave inhibiting member is then for instance made of plastics. Alternatively, at least part, preferably at least the greatest part, of the at least one glue wave inhibiting member is unable to bend or rigid. It is then preferably made of a metal material.

The embodiment in which at least part, preferably at least the greatest part, of the at least one glue wave inhibiting member is provided with a non-stick coating leads to a glue wave inhibiting member that is particularly easily to clean. The non-stick coating in particular prevents glue from irremovably adhering to or settling on the at least one glue wave inhibiting member.

The embodiment in which the at least one glue wave inhibiting assembly comprises at least one holder for holding the at least one glue wave inhibiting member preferably allows the at least one glue wave inhibiting member to be securely mounted in/to the glue container. Advantageously, it is possible as well to adjust the at least one glue wave inhibiting member to an actual glue level. It is advantageous if the at least one glue wave inhibiting member in the at least one holder protrudes from the glue and into the glue. Advantageously, the at least one holder allows the at least one glue wave inhibiting member to be replaced particularly easily. For example, the at least one glue wave inhibiting member is fixable by plugging, clamping, locking or the like. Alternatively, it is fixed by means of at least one screw or the like.

It is advantageous if due to the at least one breakthrough formed in the at least one glue wave inhibiting member to allow the glue to pass therethrough, an identical glue level is obtained on both sides of the at least one glue wave inhibiting member. The at least one breakthrough preferably forms a flow connection between the glue spaces or glue chambers of the glue container separated from each other by the at least one glue wave inhibiting member. The at least one breakthrough is for example polygonal, in particular rectangular, partly circular, circular, elliptic, rhombical, star-shaped, slot-like or in the shape of an elongated hole. It preferably reduces a flow of the glue in the glue container. The at least one breakthrough may be entirely closed or partly open at its circumference. An embodiment without breakthroughs is conceivable as well.

In a preferred embodiment of the invention, the at least one glue wave inhibiting member is passed through by a plurality of breakthroughs to allow glue to pass through the at least one glue wave inhibiting member. It is advantageous if the breakthroughs are identical in shape and/or size. Alternatively, they may be different from each other. Preferably, the breakthroughs are arranged at various vertical and/or horizontal positions perpendicular thereto. Preferably, the breakthroughs are arranged in rows and/or columns. The breakthroughs may be entirely closed and/or partly open at their circumference.

The embodiments in which each breakthrough has a breakthrough surface area of between 15 $mm^2$ and 2500 $mm^2$, preferably between 25 $mm^2$ and 1600 $mm^2$, more preferably between 100 $mm^2$ and 900 $mm^2$, with the at least one breakthrough passing through a total of between 20% and 95%, preferably between 25% and 90%, more preferably between 45% and 85% of the at least one glue wave inhibiting member, prevent glue waves from forming in the glue disposed in the glue container particularly effectively.

A preferred embodiment of the invention will hereinafter be described by way of example with reference to the enclosed drawing.

DESCRIPTION OF THE PREFERRED EMBODIMENT

Figure 1:
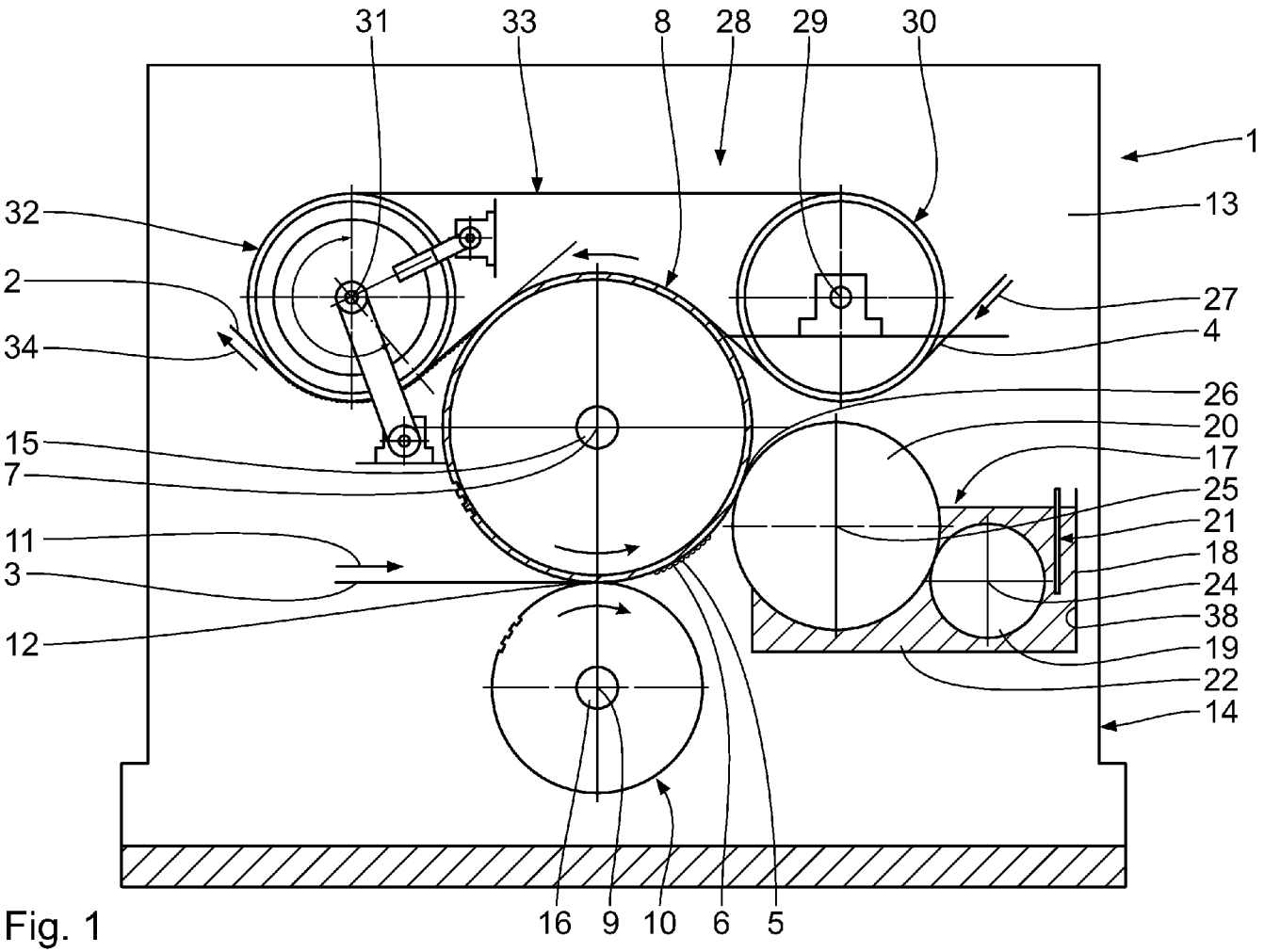
FIG. 1 shows a simplified sectional view of an assembly according to the invention, shown in FIG. 1, for producing an endless corrugated cardboard web laminated on at least one side.
Figure 2:
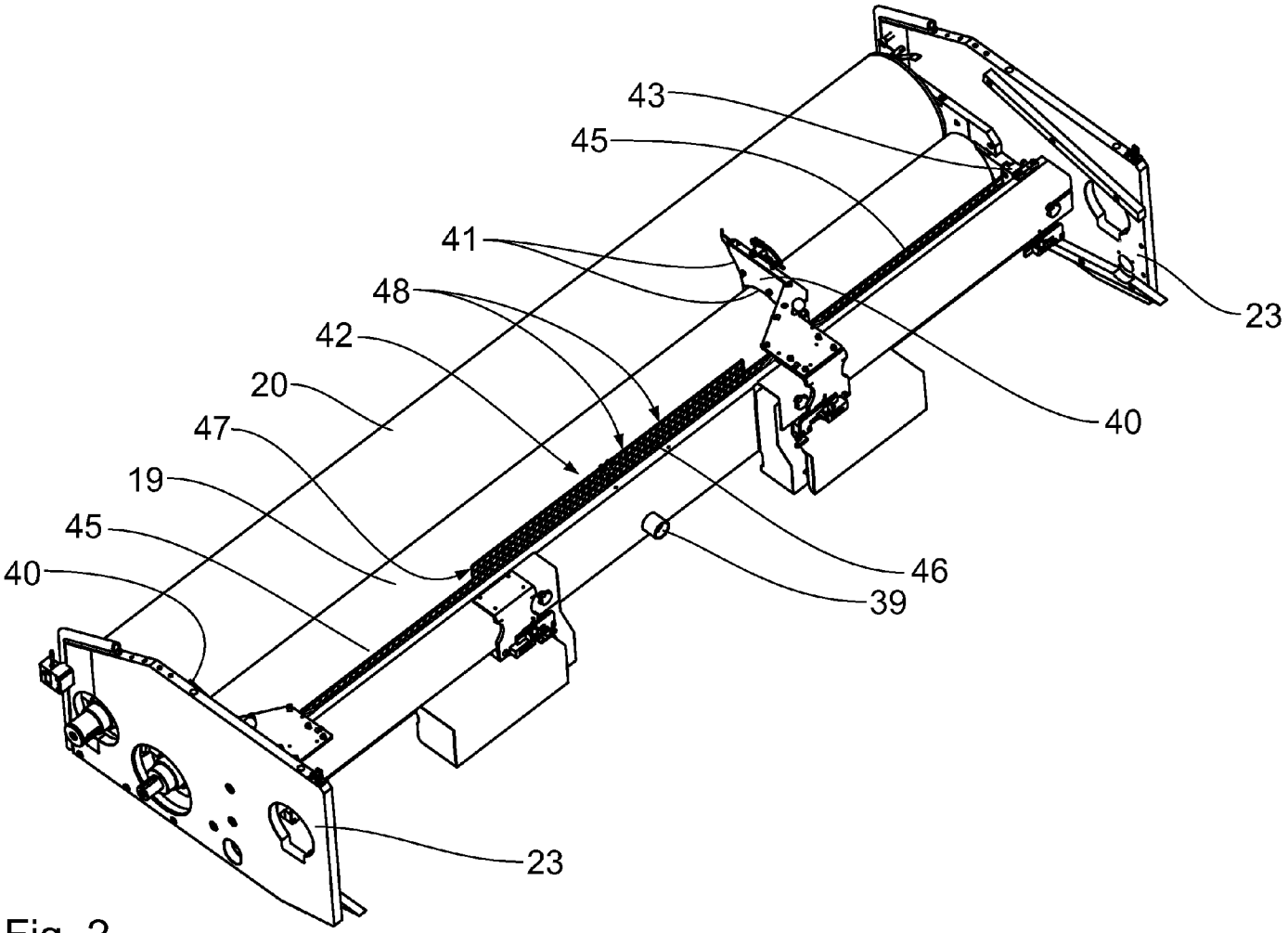
FIG. 2 shows a perspective view of a component of a glue application assembly according to the invention of the assembly for producing an endless corrugated cardboard web laminated on at least one side.
Figure 3:
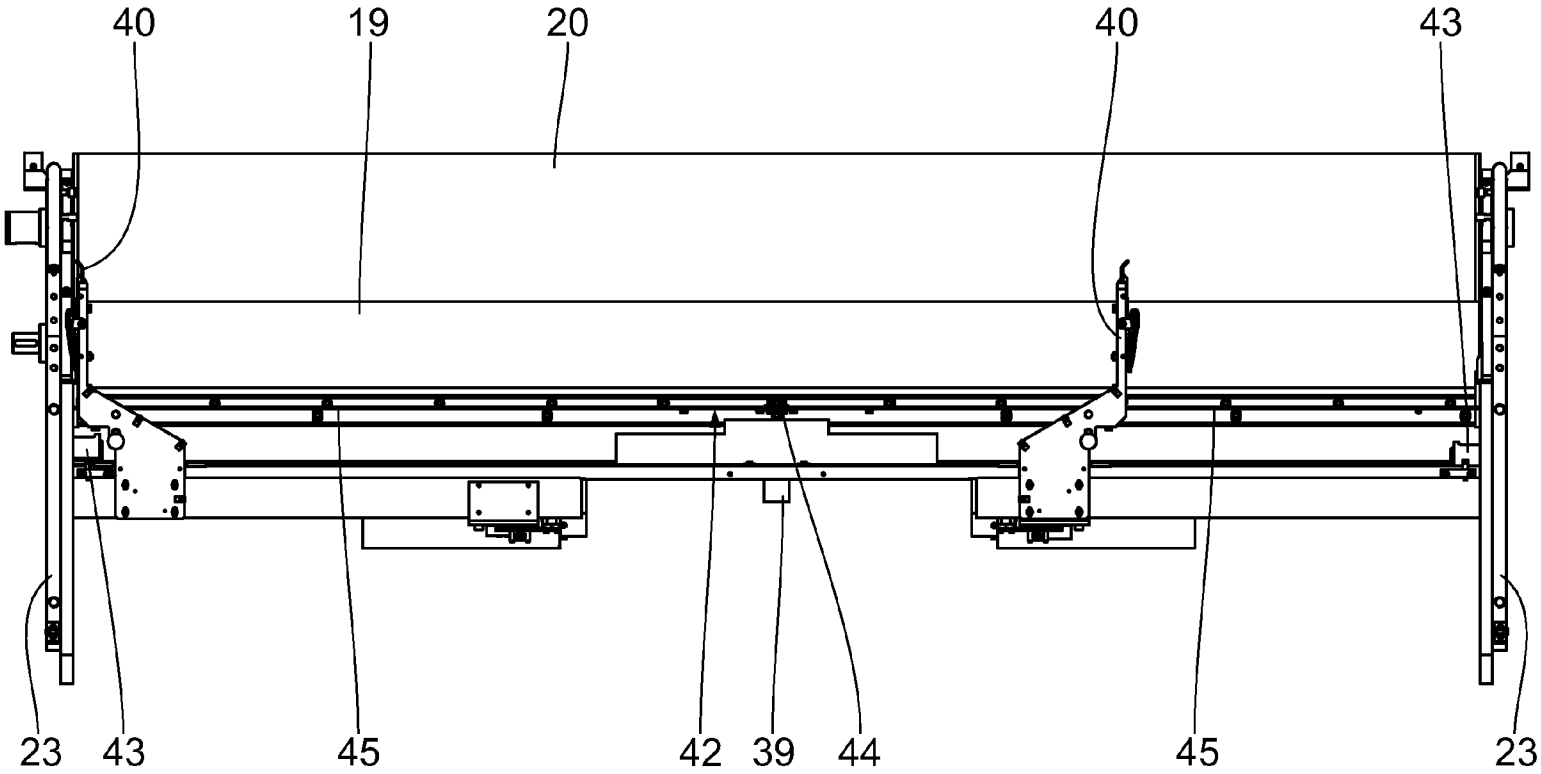
FIG. 3 shows a plan view of the component of the glue application assembly shown in FIG. 2.
Figure 4:
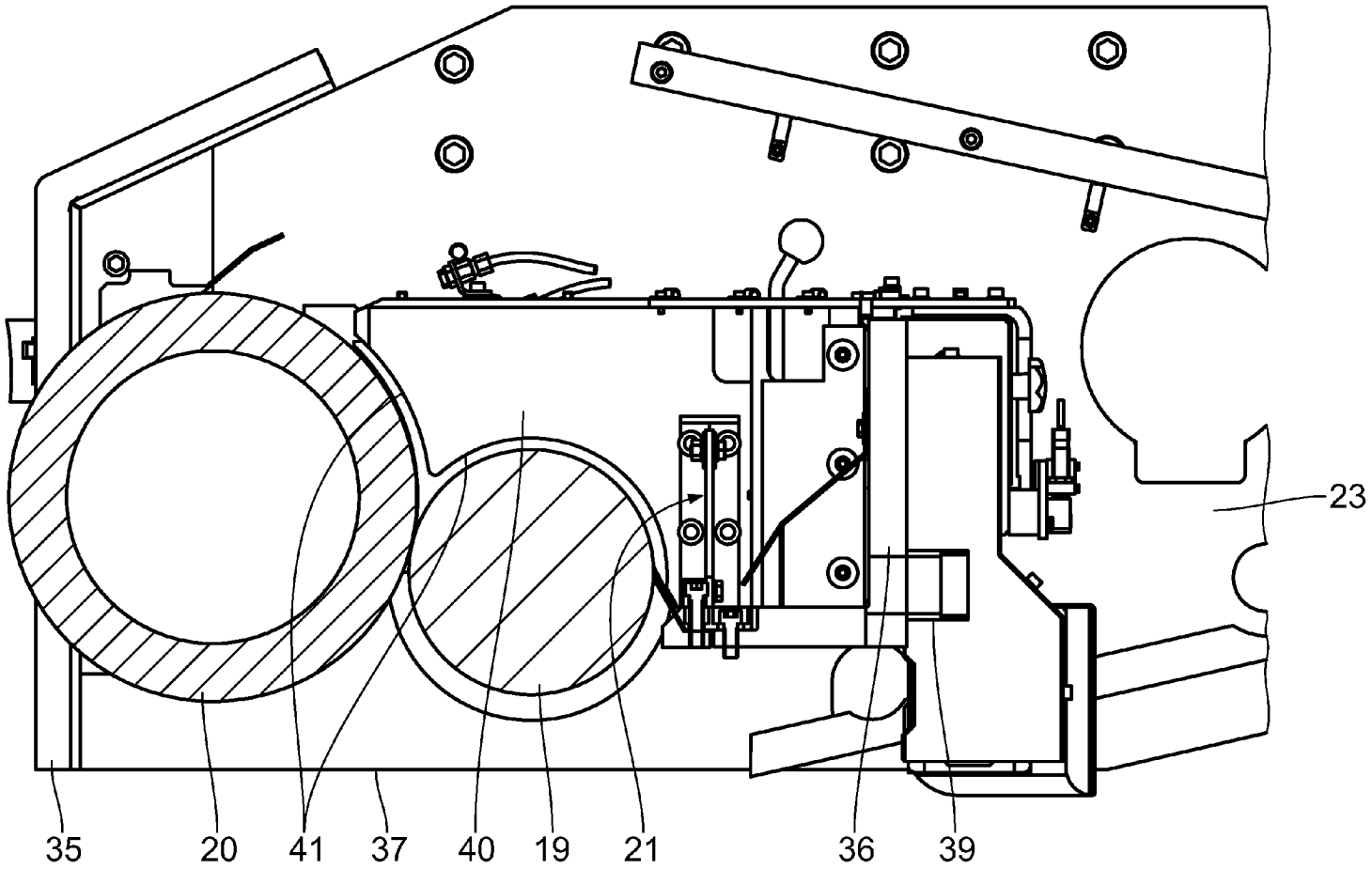
FIG. 4 shows a cross-sectional view of the component of the glue application assembly shown in FIGS. 2 and 3.
Figure 5:
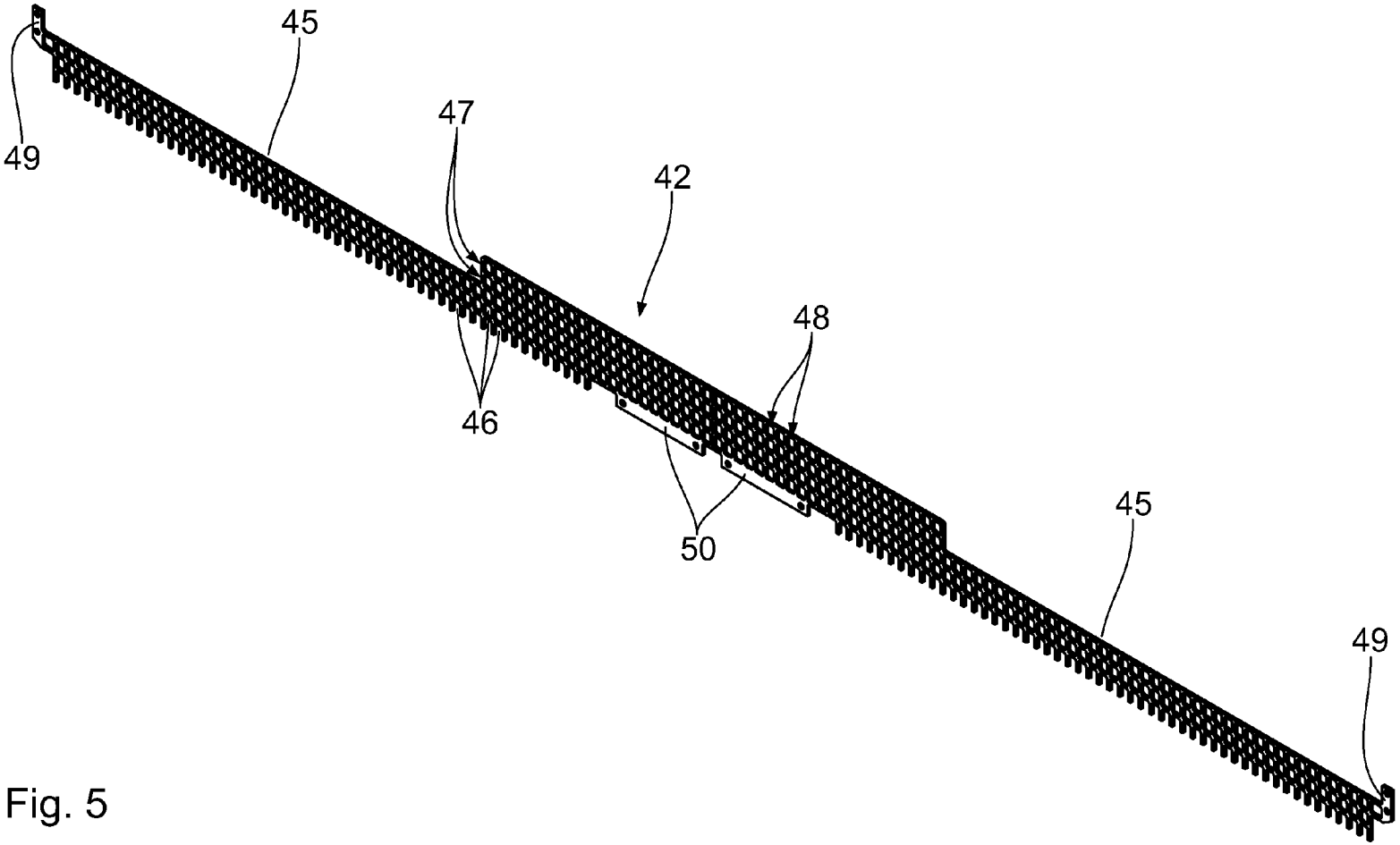
FIG. 5 shows a glue wave inhibiting member of the glue application assembly partly shown in FIGS. 2 to 4.

A corrugated cardboard installation (not fully shown) comprises an assembly 1 for producing an endless corrugated cardboard web 2 laminated on one side. The assembly 1 for producing the endless corrugated cardboard web 2 laminated on one side is shown schematically in FIG. 1.

A first splicer (not shown) and a second splicer (not shown) are arranged upstream of the assembly 1 for producing the endless corrugated cardboard web 2 laminated on at least one side.

In order to unwind a non-endless first material web from a first material web roll, the first splicer comprises a first unwinding unit and a second unwinding unit in order to unwind a non-endless second material web from a second material web roll. The non-endless first and second material webs are joined together by means of a joining and cutting unit (not shown) of the first splicer in order to provide an endless first material web 3. Each time a non-endless first material web is joined to a non-endless second material web, a first joint is produced in the endless first material web 3.

The second splicer corresponds to the first splicer. Said second splicer has a third unwinding unit in order to unwind a non-endless third material web from a third material web roll, and a fourth unwinding unit in order to unwind a non-endless fourth material web from a fourth material web roll. The non-endless third and fourth material webs are joined together by means of a joining and cutting unit (not shown) of the second splicer in order to produce an endless second material web 4. Each time a third material web is joined to a fourth material web, a second joint is produced in the endless second material web 4.

Via deflection rollers (not shown), the endless first material web 3 and the endless second material web 4 are fed to the assembly 1 for producing the endless corrugated cardboard web 2 laminated on at least one side individually.

In order to produce, from the endless first material web 3, an endless corrugated web 6 that is provided with a corrugation 5, the assembly 1 for producing the endless corrugated cardboard web 2 laminated on at least one side comprises a first corrugating roller 8 mounted for rotation about a first axis of rotation 7, and a second corrugating roller 10 mounted for rotation about a second axis of rotation 9. The axes of rotation 7, 9 are parallel to each other and perpendicular to a transport direction 11 of the endless first material web 3. The corrugating rollers 8, 10 together form a roller gap 12 allowing the endless first material web 3 to be passed through in order to be provided with a corrugation Together, they form a corrugating assembly.

Via bearings 15 and 16, the corrugating rollers 8, 10 are mounted for rotation in side parts 13 of a stationary machine frame 14 of the assembly 1 for producing the endless corrugated cardboard web 2 laminated on one side. The side parts 13 are parallel and spaced from one another. They extend vertically.

In order to join the corrugated web 6 to the endless second material web 4 to form the corrugated cardboard web 2 laminated on one side, the assembly 1 for producing the endless corrugated cardboard web 2 laminated on one side has a glue application assembly 17 arranged downstream of the corrugating rollers 8, 10, said glue application assembly 17 in turn comprising a glue container 18, a glue metering roller 19 arranged in the glue container 18, and a glue application roller 20 arranged in the glue container 18. The glue application assembly 17 is further provided with a glue wave inhibiting assembly 21 arranged in the glue container 18. Furthermore, the glue container 18 contains glue 22.

The glue application roller 20 is arranged between the glue metering roller 19 and the first corrugating roller 8. The glue metering roller 19 and the glue application roller 20 are mounted for rotation in side walls 23 of the glue container 18.

The glue metering roller 19 is mounted for rotation about a third axis of rotation 24 while the glue application roller 20 is mounted for rotation about a fourth axis of rotation 25. The axes of rotation 24, 25 are parallel to each other. They are also parallel to the axes of rotation 7, 9 of the corrugating rollers 8, 10.

The glue application roller 20 and the first corrugating roller 8 together form a roller gap 26 allowing the corrugated web 6 to be passed through to be coated with glue, said roller gap 26 thus forming a glue gap. The glue 22 disposed in the glue container 18 is applied, via the glue application roller 20 immersed in said glue 22 and rotating about the fourth axis of rotation 25, to free tips of the corrugation 5 of the corrugated web 6 transported in the transport direction 1, the corrugated web 6 abutting against the first corrugating roller 8 in said region. The glue metering roller 19 is arranged substantially opposite to the first corrugating roller 8 and adjacent to the glue application roller 20 and is adapted to form an even layer of glue on the glue application layer 20. The glue metering roller 19 is, preferably fully, immersed in the glue 22 and rotates about its third axis of rotation 24. During operation, the rollers 19, 20 are driven for rotation by means of at least one drive (not shown).

In the assembly 1 for producing the endless corrugated cardboard web 2 laminated on one side, the corrugated web 6 provided with glue 22 is then joined to the endless second material web 4 transported in a transport direction 27 to obtain the endless corrugated cardboard web 2.

In order to press the endless second material web 4 against the corrugated web 6 provided with glue 22, the corrugated web 6 partly abutting against the first corrugating roller 8 in this region, the assembly 1 for producing the endless corrugated cardboard web 2 laminated on one side is provided with a pressure assembly 28. The pressure assembly 28 is configured as a pressure belt module and arranged downstream of the glue application assembly 17 and the roller gap 26 relative to the corrugated web 6. The pressure assembly 28 is arranged above the first corrugating roller 8. It has a deflection roller 30 mounted for rotation about a fifth axis of rotation 29 and a deflection roller 32 mounted for rotation about a sixth axis of rotation 31 as well as an endless pressure belt 33 that is guided around the deflection rollers 30, 32 in a circumferential direction. The deflection roller 32 is preferably displaceable in a direction perpendicular to its sixth axis of rotation 31 to influence the tension of the pressure belt 33, if necessary. The axes of rotation 29, 31 are parallel to each other. They are also parallel to the axes of rotation 7, 9.

The first corrugating roller 8 partly engages from below a space provided between the deflection rollers 30, 32, thus causing the pressure belt 33 to be deflected by the first corrugating roller 8. It presses against the endless second material 4 which is thus pressed against the corrugated web 6 provided with glue, the corrugated web 6 abutting against the first corrugating roller 8.

It is conceivable to join another endless web to the corrugated web 6 opposite to the endless second material web 4.

The longitudinal edges of the corrugated cardboard web 2 may then be cut off using a longitudinal cutting unit (not shown). It is conceivable for the corrugated cardboard web 2 to be cut, by means of a cross-cutting unit (not shown), in a direction perpendicular to its transport direction 34 to obtain individual corrugated cardboard sheets (not shown). The corrugated cardboard sheets may be stacked in a stacking device (not shown).

The corrugated cardboard installation for producing an endless corrugated cardboard web may comprise another assembly 1 for producing another endless corrugated cardboard web 2 laminated on one side which is then glued to the other corrugated cardboard web 2 already mentioned in the manner of layers.

In the following sections, the glue application assembly 17 will be described in more detail with reference to FIGS. 2 to 5.

In addition to its side walls 23, the glue container 18 further has two opposite cross walls 35, 36 and a bottom 37. The cross walls 35, 36 are preferably parallel to each other and perpendicular to the side walls 23. The bottom 37 is in a fluid-tight connection with the side walls 23 and the cross walls 35, 36. The side walls 23 and the cross walls 35, 36 as well as the bottom 37 together define a glue receiving space 38 in which the glue 22 is disposed.

In the cross wall 36 remote from the first corrugating roller 8, a glue inlet 39 is arranged which is in fluid connection with the glue receiving space 38. Via the glue inlet 39, glue 22 may be fed to the glue receiving space 38 or to the glue container 18.

Along the cross wall 36, two glue dams 40 are mounted for displacement. Each of the glue dams 40 has a receiving recess 41 adapted to the glue metering roller 19 and the glue application roller 20, said receiving recess 41 being open towards the glue metering roller 19 and the glue application roller 20. The glue metering roller 19 and the glue application roller 20 engage the receiving recess 41. The length of and the distance between the glue dams 40 are adapted to the corrugated web 6 to be coated with glue.

The glue wave inhibiting assembly 21 is arranged adjacent to the glue metering roller 19. It is arranged between the glue metering roller 19 and the cross wall 36 arranged adjacent thereto.

The glue wave inhibiting assembly 21 has a glue wave inhibiting member 42 and two lateral holders 43 as well as an intermediate holder 44 arranged between the holders 43 for holding the glue wave inhibiting member 42. The lateral holders 43 and the intermediate holder 44 are arranged on the glue container 18. The lateral holders 43 are arranged on the side walls 23 on an inside thereof. They are opposite to each other and may also be part of the side walls 23. The intermediate holder 44 is preferably arranged centrally between the holders 43 and is preferably rigidly connected to the bottom 37. Alternatively, a plug-in connection is provided. The distance between the glue wave inhibiting member 42 and the bottom 42 may be fixed or variable.

The glue wave inhibiting member 42 is configured in the manner of a strip and preferably extends between the holders 43 such as to follow a straight line. It may be composed of one or multiple parts. The glue wave inhibiting member 42 is parallel to the third axis of rotation 24 and the fourth axis of rotation 25. According to this embodiment, it further extends vertically, in other words perpendicularly, to the bottom 37.

The glue wave inhibiting member 42 is spaced from the bottom 37. It preferably protrudes from the upper surface of the glue 22 disposed in the glue container 18. Alternatively, it starts at the bottom 37. Alternatively, it is fully arranged in the glue 22.

The glue wave inhibiting member 42 has two laterally outer glue dam recesses 45 which extend along the displacement path of the glue dams 40 so as to allow the glue dams 40 to be displaced along their displacement path in a direction parallel to the axes of rotation 24 or 25. Each of the glue dam recesses 45 is upwardly and laterally outwardly open. They are spaced from each other. The glue dam recesses 45 are engaged by holders of the glue dams. The glue wave inhibiting member 42 therefore has substantially two different heights. It has a lower height at the sides than in a central region. It is advantageous if the glue dam recesses 45 are provided with at least one sealing member (not shown) to prevent glue 22 from passing by the glue wave inhibiting member 42.

The glue wave inhibiting member 42 is provided with a plurality of breakthroughs 46. The breakthroughs 46 ensure that the glue 22 passes through the glue wave inhibiting manner 42 in a restrained manner. As such the glue 22 is able to flow from one side of the glue wave inhibiting member 42 to the other side thereof and back a random number of times, causing the flow speed of the glue 22 to be reduced. Via the breakthroughs 46, the glue 22 is in particular able to flow away from the glue metering roller 19 and towards said glue metering roller 19 again, wherein the glue 22 is calmed.

The breakthroughs 46 are arranged in horizontal rows 47 arranged one above the other. The rows 47 are parallel to each other. The breakthroughs 46 are further arranged in vertical columns 48. The columns 48 are adjacent and parallel to each other. A staggered arrangement is alternatively conceivable as well. It is advantageous if each of the lowermost breakthroughs 46 is downwardly open. The remaining breakthroughs 46 are preferably circumferentially closed.

The glue wave inhibiting member 42 is further provided with two laterally outer holding members 49 and two intermediate holding members 50 arranged therebetween. The holding members 49 engage the lateral holders 43 so as to be securely fixed therein. The intermediate holding members 50 engage the intermediate holder 44 from above so as to be securely fixed therein. As such the entire glue wave inhibiting member 42 is securely fixable relative to the glue container 18.

The glue wave inhibiting member 42 allows glue waves occurring in the glue 22 in the production of the corrugated cardboard web 2 to be reduced or prevented entirely. In particular, the glue wave inhibiting member 42 considerably reduces the flow of the glue 22 in the glue container 18.

What is claimed is:

1. An assembly for producing an endless corrugated cardboard web laminated on at least one side, the assembly comprising:

a first corrugating roller and a second corrugating roller to produce a corrugated web provided with a corrugation;

a glue application assembly comprising a glue container for receiving glue, a glue application roller for applying the glue disposed in the glue container to tips of the corrugation of the corrugated web, and at least one glue wave inhibiting assembly arranged in the glue container for inhibiting the formation of glue waves of the glue disposed in the glue container, the at least one glue wave inhibiting assembly comprising at least one glue wave inhibiting member, the at least one glue wave inhibiting member being configured as a plate or a strip, the at least one glue wave inhibiting member being passed through by a plurality of breakthroughs to allow the glue to pass through the at least one glue wave inhibiting member, wherein the at least one glue wave inhibiting member is parallel to an axis of rotation of the glue application roller, the entire at least one glue wave inhibiting member being securely fixed relative to the glue container, each breakthrough having a breakthrough surface area of between 15 $mm^2$ and 2500 $mm^2$; and a pressure assembly for pressing a cover layer against the tips of the corrugated web provided with glue.

2. An assembly according to claim 1, further comprising a glue metering roller which forms, together with the glue application roller a gap for forming a glue layer on the glue application roller, wherein the glue metering roller is arranged between the glue application roller and the at least one glue wave inhibiting assembly.

3. An assembly according to claim 1, wherein the at least one glue wave inhibiting member extends at least partly between side walls of the glue container.

4. An assembly according to claim 1, wherein the at least one glue wave inhibiting member extends vertically.

5. An assembly according to claim 1, wherein the at least one glue wave inhibiting member extends at an angle relative to a vertical.

6. An assembly according to claim 1, wherein an inclination of the at least one glue wave inhibiting member is displaceable relative to a vertical.

7. An assembly according to claim 1, wherein at least part of the at least one glue wave inhibiting member is bendable.

8. An assembly according to claim 1, wherein at least part of the at least one glue wave inhibiting member is unable to bend.

9. An assembly according to claim 1, wherein at least part of the at least one glue wave inhibiting member is provided with a non-stick coating.

10. An assembly according to claim 1, wherein the at least one glue wave inhibiting assembly comprises at least one holder for holding the at least one glue wave inhibiting member.

11. An assembly according to claim 1, wherein the at least one breakthrough passes through a total of between 20% and 95% of the at least one glue wave inhibiting member.

12. An assembly according to claim 11, wherein the at least one breakthrough passes through a total of between 25% and 90% of the at least one glue wave inhibiting member.

13. An assembly according to claim 11, wherein the at least one breakthrough passes through a total of between 45% and 85% of the at least one glue wave inhibiting member.

14. A glue application assembly as a component of an assembly for producing an endless corrugated cardboard web laminated on at least one side, the glue application assembly comprising:

a glue container for receiving glue;

a glue application roller for applying the glue disposed in the glue container to tips of the corrugation of the corrugated web, the glue application roller comprising a glue application roller longitudinal axis; and at least one glue wave inhibiting assembly arranged in the glue container for inhibiting the formation of glue waves of the glue disposed in the glue container, the at least one glue wave inhibiting assembly comprising at least one glue wave inhibiting member, the at least one glue wave inhibiting member being configured as a plate or a strip, the at least one glue wave inhibiting member being passed through by a plurality of breakthroughs to allow the glue to pass through the at least one glue wave inhibiting member, wherein the at least one glue wave inhibiting member is parallel to the glue application roller longitudinal axis, the entire at least one glue wave inhibiting member being fixed in a position relative to the glue container, each breakthrough having a breakthrough surface area of between 15 $mm^2$ and 2500 $mm^2$.

15. A glue application assembly as a component of an assembly for producing an endless corrugated cardboard web laminated on at least one side, the glue application assembly comprising:

a glue container for receiving glue;

a glue application roller for applying the glue disposed in the glue container to tips of the corrugation of the corrugated web, the glue application roller comprising a glue application roller longitudinal axis; and a glue wave inhibiting assembly arranged in the glue container for inhibiting a formation of glue waves of the glue disposed in the glue container, the glue wave inhibiting assembly comprising at least one glue wave inhibiting member, the at least one glue wave inhibiting member comprising a plurality of openings, said plurality of openings comprising a plurality of horizontal rows of openings and a plurality of vertical columns of openings, the horizontal rows of openings being arranged one above another, each one of the vertical columns of openings being arranged adjacent to another one of the vertical columns of openings, wherein each of the plurality of openings has one end arranged on one side of the glue wave inhibiting assembly and another end arranged on another side of the glue wave inhibiting assembly, wherein the at least one glue wave inhibiting member is parallel to the glue application roller longitudinal axis, the at least one glue wave inhibiting member being in a fixed position relative to the glue container, each opening having an opening surface area of between 15 $mm^2$ and 2500 $mm^2$.

16. An assembly according to claim 15, wherein the at least one glue wave inhibiting member comprises one of a plate and a strip, wherein the plurality of openings passes through a total of between 20% and 95% of the at least one glue wave inhibiting member, wherein glue passes through at least one of the openings of at least one of the horizontal row of openings and at least one of the openings in at least one of the vertical columns of openings.

17. An assembly according to claim 15, wherein the container comprises a first lateral wall, a second lateral wall and a transverse wall extending between the first lateral wall and the second lateral wall, the at least one glue wave inhibiting member extending between the first lateral wall and the second lateral wall, the at least one glue wave inhibiting member being arranged between the transverse wall and the glue application roller, wherein the at least one glue wave inhibiting member is located at a spaced location from the glue application roller, the at least one glue wave inhibiting member being parallel to the transverse wall.

* * * * *